US010538974B2

(12) United States Patent
Patwa et al.

(10) Patent No.: US 10,538,974 B2
(45) Date of Patent: Jan. 21, 2020

(54) LOAD-BEARING UNIVERSAL JOINT WITH SELF-ENERGIZING SEALS FOR A ROTARY STEERABLE DRILLING TOOL

(71) Applicant: HALLIBURTON ENERGY SERVICES, INC., Houston, TX (US)

(72) Inventors: Ruchir Shirish Patwa, Tomball, TX (US); Daniel Winslow, Spring, TX (US); Neelesh Deolalikar, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 97 days.

(21) Appl. No.: 15/541,965

(22) PCT Filed: Mar. 6, 2015

(86) PCT No.: PCT/US2015/019257
§ 371 (c)(1),
(2) Date: Jul. 6, 2017

(87) PCT Pub. No.: WO2016/144303
PCT Pub. Date: Sep. 15, 2016

(65) Prior Publication Data

US 2018/0002991 A1 Jan. 4, 2018

(51) Int. Cl.
*E21B 17/05* (2006.01)
*E21B 7/06* (2006.01)

(52) U.S. Cl.
CPC ..... *E21B 17/05* (2013.01); *E21B 7/062* (2013.01)

(58) Field of Classification Search
CPC ..... E21B 17/05; E21B 4/003; E21B 7/061; E21B 7/062
See application file for complete search history.

(56) References Cited

U.S. PATENT DOCUMENTS 4,904,228 A * 2/1990 Frear ..... E21B 17/05 464/152
6,092,610 A 7/2000 Kosmala et al.
(Continued)

OTHER PUBLICATIONS

International Search Report and Written Opinion for International Application No. PCT/US2015/019257 dated Dec. 4, 2015. (16 pages).

*Primary Examiner* — David J Bagnell
*Assistant Examiner* — Dany E Akakpo
(74) *Attorney, Agent, or Firm* — Haynes and Boone, LLP

(57) ABSTRACT

A rotary steerable drilling tool and a method according to which a universal joint is sealed. In one embodiment, the method includes providing the collar, the shaft, the universal joint, and first and second shoulders between which the universal joint is positioned; providing first and second self-energizing seals between the collar and the shaft on opposite sides of the universal joint; rotating the collar and the shaft; seating the first self-energizing seal against the first shoulder; and seating a second self-energizing seal against the second shoulder. In one embodiment, the universal joint includes a convex surface formed on the shaft; a first concave surface extending circumferentially about the shaft and adapted to mate with the convex surface to carry a first axial load; and a spacer ring defining a second concave surface adapted to mate with the convex surface to carry a second axial load.

31 Claims, 8 Drawing Sheets

(56) References Cited

U.S. PATENT DOCUMENTS

| | | | | |
|---|---|---|---|---|
| 6,109,372 | A * | 8/2000 | Dorel | E21B 47/08 175/269 |
| 6,837,315 | B2 | 1/2005 | Pisoni et al. | |
| 7,383,897 | B2 * | 6/2008 | Moody | E21B 7/062 175/61 |
| 2001/0052427 | A1 | 12/2001 | Eppink et al. | |
| 2004/0104051 | A1 | 6/2004 | Moriarty et al. | |
| 2004/0262043 | A1 | 12/2004 | Schuaf | |
| 2009/0133936 | A1 | 5/2009 | Hall et al. | |

* cited by examiner

LOAD-BEARING UNIVERSAL JOINT WITH SELF-ENERGIZING SEALS FOR A ROTARY STEERABLE DRILLING TOOL

TECHNICAL FIELD

The present disclosure relates generally to well drilling operations and, more specifically, to enhancing the performance of a rotary steerable drilling tool by utilizing a load-bearing universal joint with self-energizing seals.

BACKGROUND

In the process of directionally drilling an oil or gas wellbore, a rotary steerable drilling tool is run downhole on a tubular drill string. The rotary steerable drilling tool includes a collar, a bit shaft, an angulating mechanism, and a universal joint. The bit shaft extends within the collar and supports a rotary drill bit. In order to drill the wellbore, the drill string is rotated while applying weight-on-bit to the rotary drill bit, thereby causing the rotary drill bit to rotate against the bottom of the wellbore. At the same time, a drilling fluid is communicated through the drill string and ejected into the wellbore through jets in the rotary drill bit, thereby clearing away drill cuttings from the rotary drill bit. The angulating mechanism is disposed within the collar and is adapted to change the angle and azimuth of the bit shaft in relation to the collar during drilling operations, thereby changing the path of the wellbore. The universal joint is adapted to transfer torque and rotation from the collar to the bit shaft, even though the angulating mechanism may vary the angle and azimuth of the bit shaft in relation to the collar. Components within the rotary steerable drilling tool are capable of: sealing the universal joint from contamination; and carrying the axial, radial, and torsional loads applied to the bit shaft. However, such components tend to have a low mean time between failures and/or may take up a significant amount of space within the rotary steerable drilling tool. Further, such components may increase the distance between the rotary drill bit and the universal joint (i.e., the bit-to-bend distance). In some cases, the bit-to-bend distance may need to be reduced in order to increase the range of angle and azimuth that the angulating mechanism can impart to the bit shaft. Therefore, what is needed is a system, assembly, method, or apparatus that addresses one or more of these issues, and/or other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
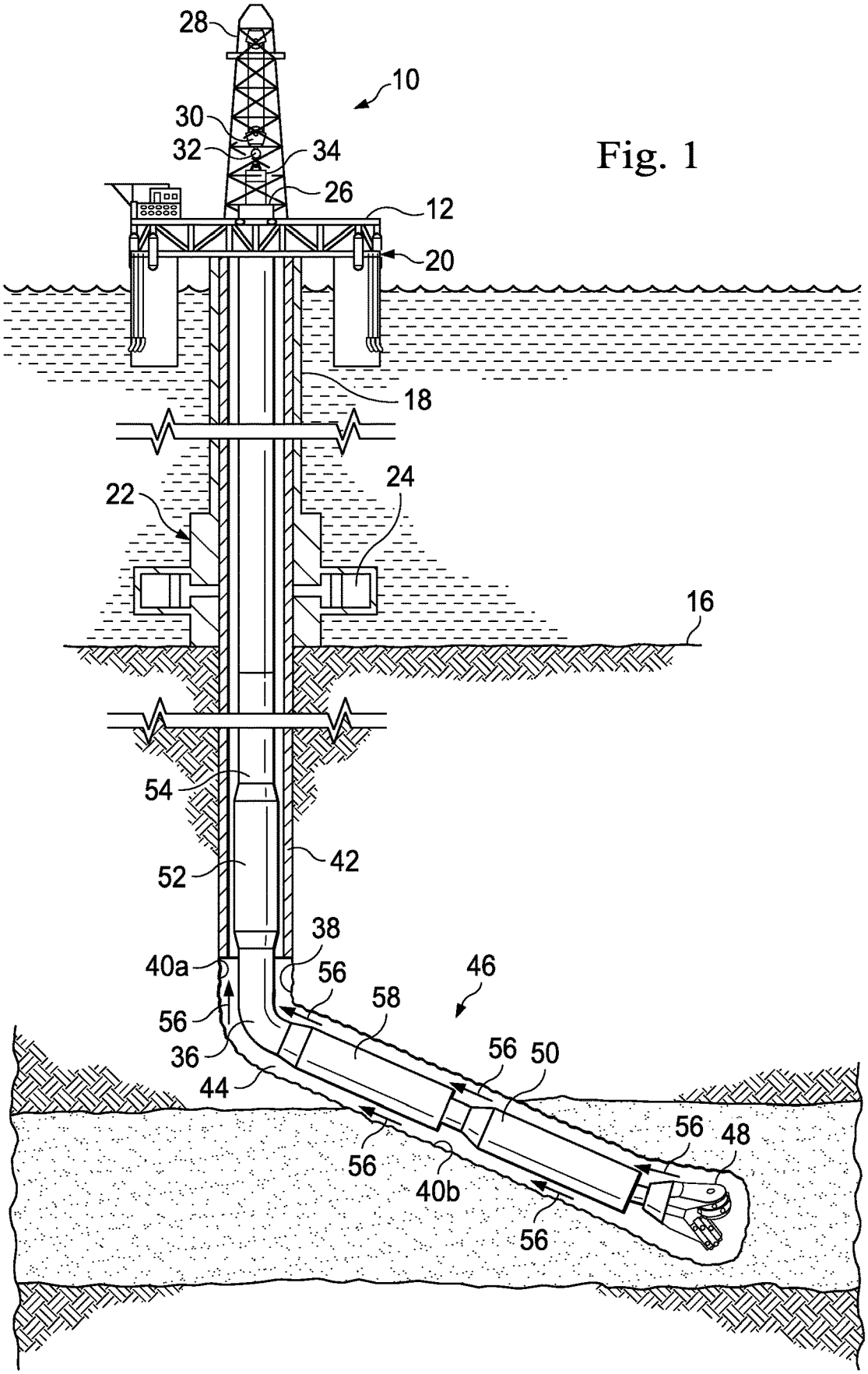
FIG. 1 is a schematic illustration of an offshore oil and gas platform operably coupled to a bottom-hole assembly disposed within a wellbore, the bottom-hole assembly including a rotary steerable drilling tool, according to an exemplary embodiment.

Illustrative embodiments and related methods of the present disclosure are described below as they might be employed in a load-bearing universal joint with self-energizing seals for a rotary steerable drilling tool. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The following disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

In an exemplary embodiment, as illustrated in FIG. 1, an offshore oil or gas platform is schematically illustrated and generally designated by the reference numeral 10. A semisubmersible platform 12 is positioned over a submerged oil and gas formation 14 located below a sea floor 16. A subsea conduit 18 extends from a deck 20 of the platform 12 to a subsea wellhead installation 22, which includes blowout preventers 24. The platform 12 has a hoisting apparatus 26, a derrick 28, a travel block 30, a hook 32, and a swivel 34 for raising and lowering pipe strings, such as a substantially tubular, axially extending drill string 36. A wellbore 38 extends through the various earth strata, including the formation 14, and may include an upper section 40*a* and a lower section 40*b*. The wellbore 38 includes a casing string 42 cemented in a portion thereof. An annulus 44 is defined between the wellbore 38 and the drill string 36. A bottom-hole assembly 46 is connected at the lower end portion of the drill string 36 and extends within the wellbore 38. The bottom-hole assembly 46 includes a rotary drill bit 48 supported by a rotary steerable drilling tool 50, which is adapted to drill directionally through the various earth strata, including the formation 14. The bottom-hole assembly 46 may also include other components such as, for example, stabilizers, reamers, shocks, hole-openers, measurement-while-drilling tools, or any combination thereof. One or more drill collars 52 are connected by drill pipes 54 at intervals within the drill string 36. The drill collars 52 are adapted to put weight on the rotary drill bit 48 through the drill string 36 during drilling operations (referred to as "weight-on-bit").

In an exemplary embodiment, the wellbore 38 is drilled by rotating the drill string 36 via a rotary table or top-drive (not shown) while applying weight-on-bit to the bottom-hole assembly 46, thereby rotating the rotary drill bit 48 against the bottom of the wellbore 38. The rotary steerable drilling tool 50 is capable of controlling and changing the angle and azimuth of the rotary drill bit 48 relative to the wellbore 38 during drilling operations, as will be discussed in further detail below. Changing the angle and azimuth of the rotary drill bit 48 during drilling operations enables directional-drilling of the wellbore 38, such that the upper section 40*a* may be drilled in a substantially vertical direction and the lower section 40*b* may be drilled in a deviated, curved, or horizontal direction, as shown in FIG. 1. As the rotary drill bit 48 drills through the various earth strata, including the formation 14, a drilling fluid 56 is circulated from the surface, through the drill string 36 and the bottom-hole assembly 46, and into the wellbore 38. The drilling fluid 56 flows into the wellbore 38 through jets (not shown) in the rotary drill bit 48, thereby clearing away drill cuttings (not shown) from the rotary drill bit 48 and carrying the drill cuttings to the surface through the annulus 44. The bottom-hole assembly 46 further includes a power section 58 such as, for example, a mud motor or turbine, connected above the rotary steerable drilling tool 50. The power section 58 includes a rotor (not shown) that is operably coupled to the rotary drill bit 48. As the drilling fluid 56 is circulated through the drill string 36, the bottom-hole assembly 46, and the annulus 44 during drilling operations, the drilling fluid 56 imparts rotation to the rotor of the power section 58, which rotor, in turn, drives the rotary drill bit 48. In this manner, the power section 58 is utilized to increase the rotational speed of the rotary drill bit 48 above the rotational speed applied to the drill string 36 by the rotary table or top-drive (not shown). Although FIG. 1 depicts the power section 58 located above the rotary steerable drilling tool 50 in the bottom-hole assembly 46, the power section 58 may alternately be located elsewhere in the bottom-hole assembly 46 such as, for example, between the rotary drill bit 48 and the rotary steerable drilling tool 50. Alternatively, the power section 58 may be omitted from the bottom-hole assembly 46.

Although FIG. 1 depicts a horizontal wellbore, it should be understood by those skilled in the art that the illustrative embodiments of the present disclosure are equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the illustrative embodiments of the present disclosure are equally well suited for use in onshore operations. Further, even though FIG. 1 depicts a cased hole completion, it should be understood that the illustrative embodiments of the present disclosure are equally well suited for use in open hole completions.

Figure 2:
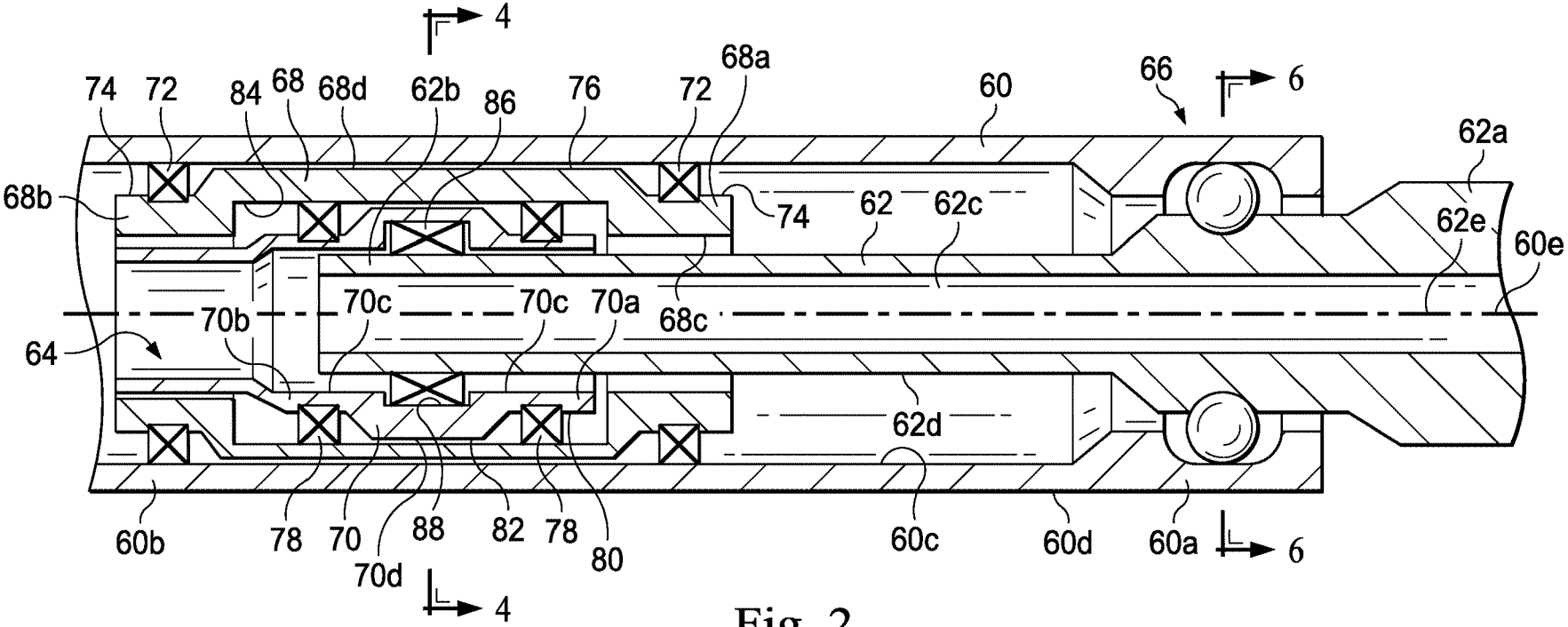
FIG. 2 is a sectional diagrammatic view of the rotary steerable drilling tool of FIG. 1 in a straight-line drilling configuration, the rotary steerable drilling tool including a collar, a bit shaft, a universal joint, and an angulating mechanism, according to an exemplary embodiment.
Figure 3:
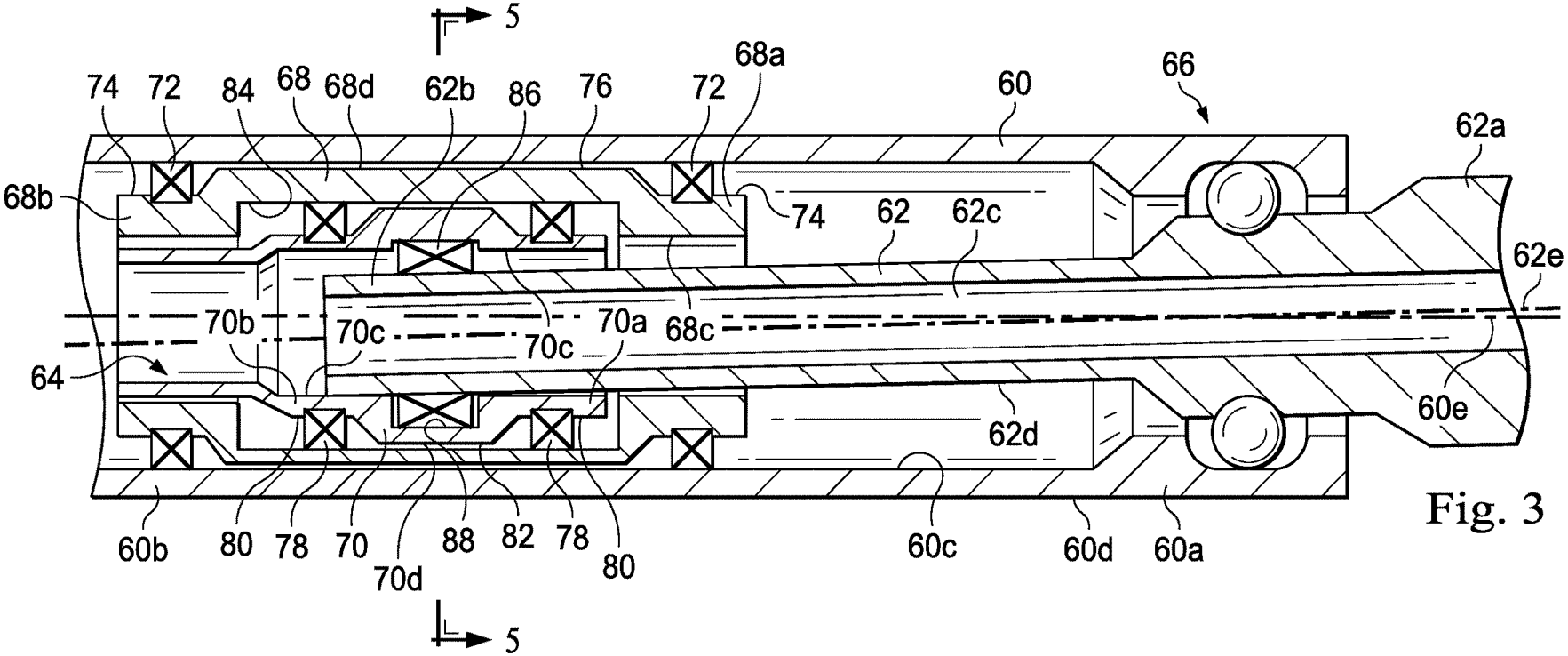
FIG. 3 is a sectional diagrammatic view of the rotary steerable drilling tool of FIGS. 1 and 2 in a directional-drilling configuration, according to an exemplary embodiment.

In an exemplary embodiment, as illustrated in FIGS. 2 and 3 with continuing reference to FIG. 1, the rotary steerable drilling tool 50 includes a collar 60, a bit shaft 62, an angulating mechanism 64, and a universal joint 66 such as, for example, a constant-velocity joint. The collar 60 is generally tubular and includes opposing end portions 60*a*, 60*b*. Further, the collar 60 defines an interior surface 60*c*, an exterior surface 60*d*, and a longitudinal axis 60*e*. The collar 60 is operably coupled to both the power section 58 and the drill string 36, as shown in FIG. 1. However, as discussed above, the power section 58 may be omitted from the bottom-hole assembly 46. Thus, rotation is imparted to the collar 60 from: the drill string 36 when the rotary table or top-drive (not shown) drives the drill string 36; and/or the power section 58 when the drilling fluid 56 imparts rotation to the rotor (not shown). The bit shaft 62 extends within the collar 60 and includes opposing end portions 62*a*, 62*b*. Further, the bit shaft 62 defines an interior flow passage 62*c*, an exterior surface 62*d*, and a longitudinal axis 62*e*. Any rotation imparted to the collar 60 is transferred to the bit shaft 62 through the universal joint 66, as will be discussed in further detail below. The end portion 62*a* of the bit shaft 62 protrudes from the end portion 60*a* of the collar 60, and is adapted to support the rotary drill bit 48 (shown in FIG. 1) during drilling operations. During drilling operations, the interior flow passage 62*c* of the bit shaft 62 directs the flow of the drilling fluid 56 (shown in FIG. 1) from the rotary steerable drilling tool 50 to the rotary drill bit 48. The drilling fluid 56 is then ejected into the wellbore 38 through the jets (not shown) in the rotary drill bit 48, as discussed above.

In an exemplary embodiment, the angulating mechanism 64 includes an outer eccentric ring 68 and an inner eccentric ring 70. The outer eccentric ring 68 includes opposing end portions 68*a*, 68*b*, and is disposed within the collar 60 proximate the end portion 60*b* thereof. Further, the outer eccentric ring 68 defines an internal bore 68*c* and an exterior surface 68*d*, which are spaced in an eccentric relation. A pair of axially-spaced radial bearings 72 are disposed between the exterior surface 68*d* of the outer eccentric ring 68 and the interior surface 60*c* of the collar 60, thereby supporting the end portions 68*a*, 68*b* of the outer eccentric ring 68 within the collar 60. The axially-spaced radial bearings 72 permit the outer eccentric ring 68 to rotate relative to the collar 60, and vice-versa, as the collar 60 is driven by the rotary table (not shown) and/or the power section 58. As shown in FIGS. 2 and 3, in an exemplary embodiment, the exterior surface 68*d* of the outer eccentric ring 68 defines a pair of reduced diameter sections 74 located at the end portions 68*a*, 68*b*, and defines an enlarged diameter section 76 located between the end portions 68*a*, 68*b*. The axially-spaced radial bearings 72 are disposed about the reduced diameter sections 74 of the outer eccentric ring 68. Thus, the axially-spaced radial bearings 72 are carried between the reduced diameter sections 74 of the outer eccentric ring 68 and the interior surface 60*c* of the collar 60.

The inner eccentric ring 70 includes opposing end portions 70*a*, 70*b*, and is disposed within the outer eccentric ring 68. Further, the inner eccentric ring 70 defines an internal bore 70*c* and an exterior surface 70*d*, which are spaced in an eccentric relation. A pair of axially-spaced radial bearings 78 are disposed between the exterior surface 70*d* of the inner eccentric ring 70 and the internal bore 68*c* of the outer eccentric ring 68, thereby supporting the end portions 70*a*, 70*b* of the inner eccentric ring 70 within the outer eccentric ring 68. The axially-spaced radial bearings 78 permit the inner eccentric ring 70 to rotate relative to the outer eccentric ring 68, and vice-versa, as the collar 60 is driven by the rotary table (not shown) and/or the power section 58. As shown in FIGS. 2 and 3, in an exemplary embodiment, the exterior surface 70*d* of the inner eccentric ring 70 defines a pair of reduced diameter sections 80 located at the end portions 70*a*, 70*b*, and defines an enlarged diameter section 82 located between the end portions 70*a*, 70*b*. The axially-spaced radial bearings 78 are disposed about the reduced diameter sections 80 of the inner eccentric ring 70. Additionally, the internal bore 68*c* of the outer eccentric ring 68 defines an internal annular recess 84 located between the end portions 68*a*, 68*b* thereof. The internal annular recess 84 is adapted to receive the axially-spaced radial bearings 78. Thus, the axially-spaced radial bearings 78 are carried between the reduced diameter sections 80 of the inner eccentric ring 70 and the internal annular recess 84 defined by the internal bore 68*c* of the outer eccentric ring 68.

The internal bore 70*c* of the inner eccentric ring 70 supports the end portion 62*b* of the bit shaft 62, via a radial bearing 86. The radial bearing 86 is disposed between the exterior surface 62*d* of the bit shaft 62 and the internal bore 70*c* of the inner eccentric ring 70. The radial bearing 86 permits the inner eccentric ring 70 to rotate relative to the bit shaft 62, and vice-versa, as the collar 60 is driven by the rotary table (not shown) and/or the power section 58. Additionally, the radial bearing 86 is capable of supporting the bit shaft 62, even as the angle and azimuth of the bit shaft 62 relative to the collar 60 are altered by the angulating mechanism 64 during drilling operations. As shown in FIGS. 2 and 3, in an exemplary embodiment, the internal bore 70*c* of the inner eccentric ring 70 defines an internal annular recess 88 located between the end portions 70*a*, 70*b* thereof. The internal annular recess 88 is adapted to receive the radial bearing 86. The radial bearing 86 is thus carried between the exterior surface 62*d* of the bit shaft 62 and the internal annular recess 88 that is defined by the internal bore 70*c* of the inner eccentric ring 70.

Figure 4:
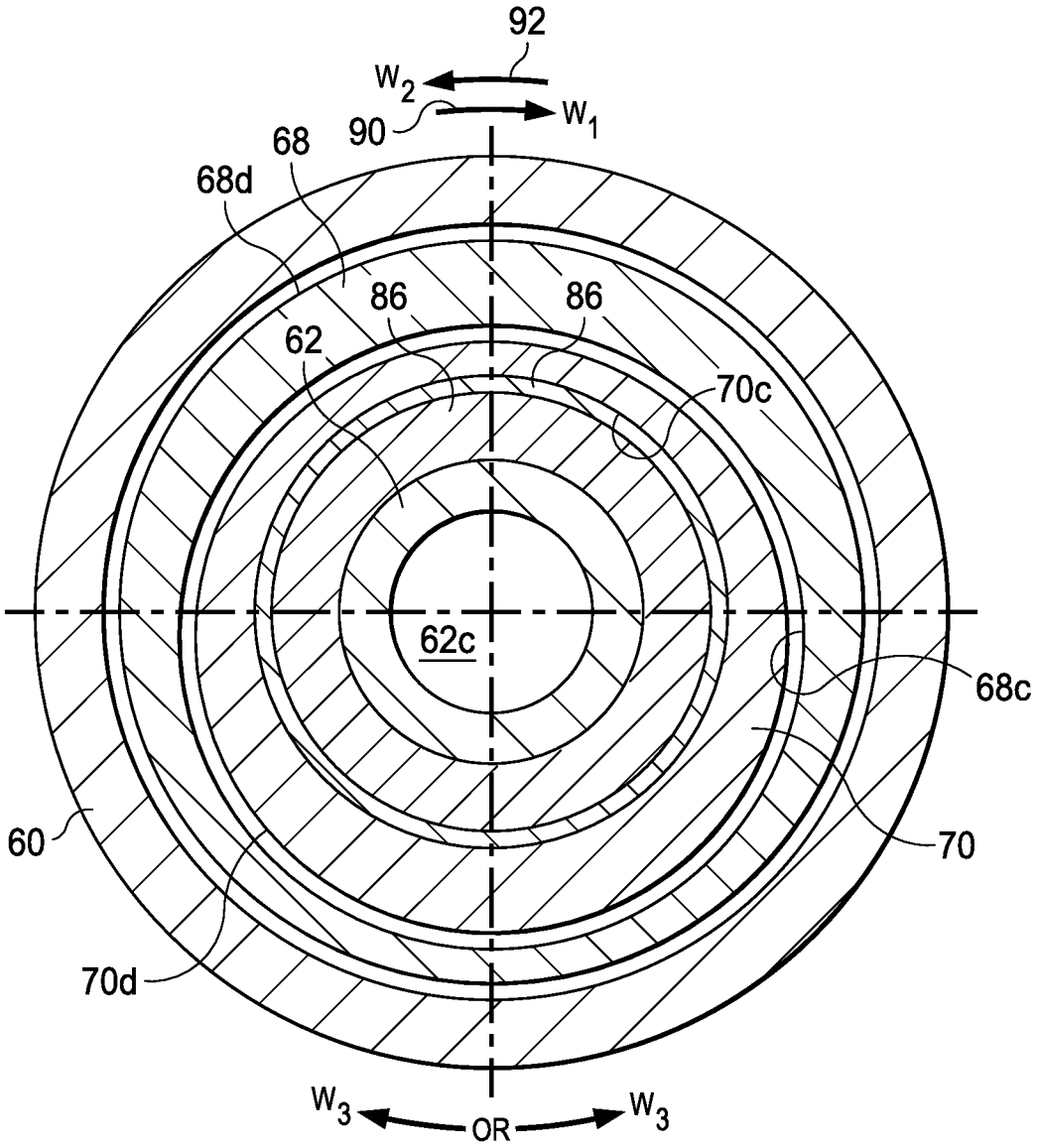
FIG. 4 is a cross-sectional diagrammatic view of the angulating mechanism of FIGS. 2 and 3, taken along line 4-4 of FIG. 2, according to an exemplary embodiment.
Figure 5:
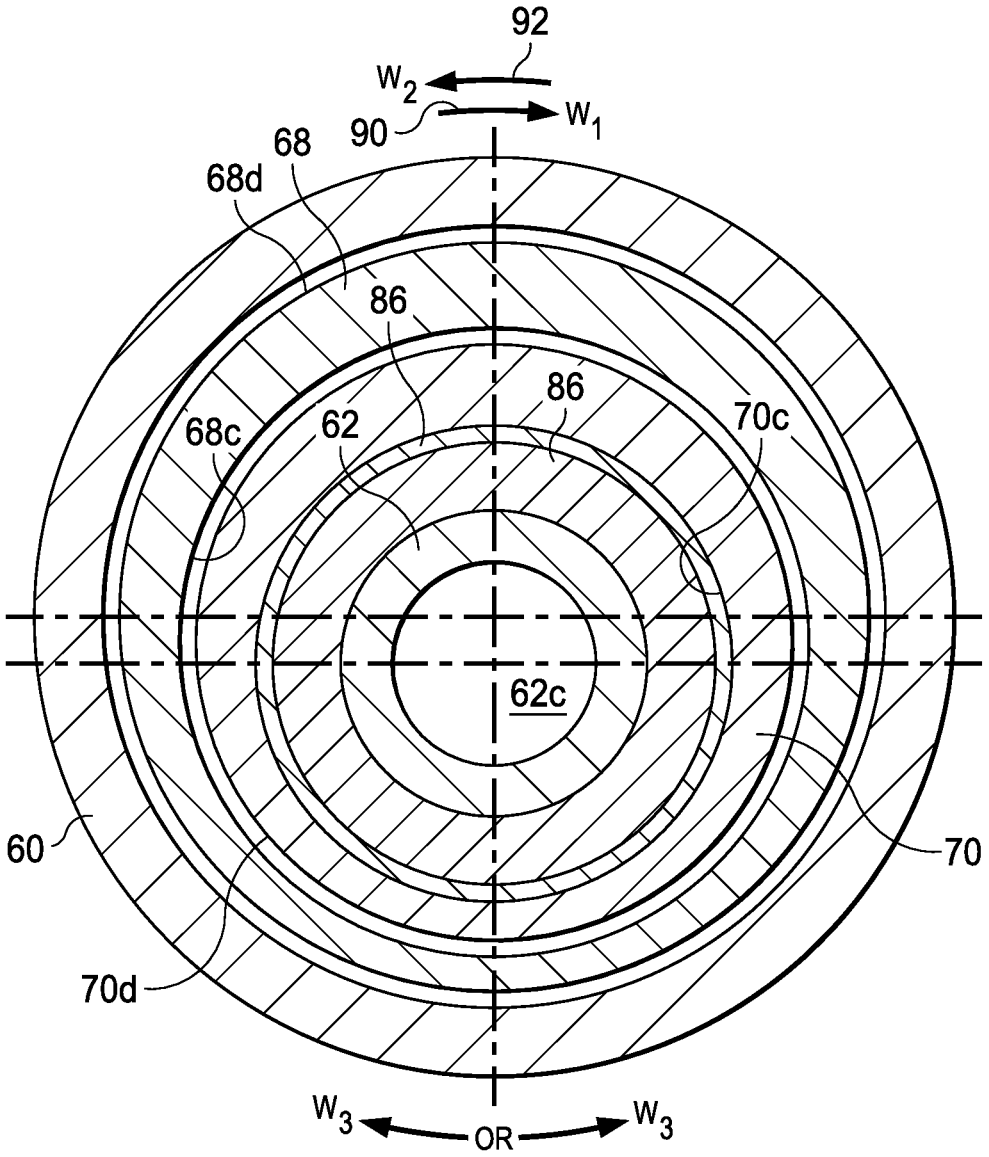
FIG. 5 is a cross-sectional diagrammatic view of the angulating mechanism of FIGS. 2 and 3, taken along line 5-5 of FIG. 3, according to an exemplary embodiment.

In an exemplary embodiment, the rotary steerable drilling tool 50 is adapted to operate in a straight-line drilling configuration, as shown in FIGS. 2 and 4, and in multiple directional-drilling configurations, one of which is shown in FIGS. 3 and 5. Whether the rotary steerable drilling tool 50 is operated in the straight-line drilling configuration or in one of the multiple directional-drilling configurations, the universal joint 66 supports the bit shaft 62 at the end portion 60*a* of the collar 60. In the straight-line configuration, as shown in FIGS. 2 and 4, both of the angle and azimuth of the bit shaft 62 in relation to the collar 60 are zero. The internal bore 70*c* of the inner eccentric ring 70 supports the end portion 62*b* of the bit shaft 62, via the radial bearing 86. Furthermore, the outer eccentric ring 68 and the inner eccentric ring 70 are oriented such that the internal bore 70*c* of the inner eccentric ring 70 and the exterior surface 68*d* of the outer eccentric ring 68 are spaced in a concentric relation, as shown in FIG. 4. As a result, the end portion 62*b* of the bit shaft 62 is supported within the collar 60 such that the longitudinal axis 60*e* of the collar 60 and the longitudinal axis 62*e* of the bit shaft 62 are maintained in either a co-axial or parallel relation, as shown in FIG. 2. Thus, in the straight-line drilling configuration, the rotary steerable drilling tool 50 is operable to drill the wellbore 38 along a straight path. In each of the multiple directional-drilling configurations, one of which is shown in FIGS. 3 and 5, one or both of the angle and azimuth of the bit shaft 62 in relation to the collar 60 is greater than zero. As mentioned above, the internal bore 70*c* of the inner eccentric ring 70 supports the end portion 62*b* of the bit shaft 62, via the radial bearing 86. Furthermore, the outer eccentric ring 68 and the inner eccentric ring 70 are oriented such that the internal bore 70*c* of the inner eccentric ring 70 and the exterior surface 68*d* of the outer eccentric ring 68 are spaced in an eccentric relation, as shown in FIG. 5. As a result, the end portion 62*b* of the bit shaft 62 is supported within the collar 60 such that the longitudinal axis 60*e* of the collar 60 and the longitudinal axis 62*e* of the bit shaft 62 are maintained in an oblique relation, as shown in FIG. 3. Thus, in each of the multiple directional-drilling configurations, the rotary steerable drilling tool 50 is operable to drill the wellbore 38 along a deviated or curved path.

In operation, as illustrated in FIGS. 1-5, the collar 60 is driven by the rotation of the drill string 36 and/or the power section 58. As torque and rotation are applied to the collar 60, the universal joint 66 transfers the torque and rotation to the bit shaft 62, thereby causing the bit shaft 62 to rotate along with the collar 60 at an angular speed $\omega_1$ and in an angular direction, as indicated by reference numeral 90. As the collar 60 and the bit shaft 62 rotate in the angular direction 90, an outer driver (not shown) drives the outer eccentric ring 68 at an angular speed $\omega_2$ and in an angular direction that is opposite the angular direction 90, as indicated by reference numeral 92. In an exemplary embodiment, the outer driver (not shown) includes a brake, which is operable to decrease or halt the angular speed $\omega_2$ of the outer eccentric ring 68 in relation to the collar 60. As the collar 60 and the bit shaft 62 rotate in the angular direction 90 and the outer eccentric ring 68 rotates in the angular direction 92, an inner driver (not shown) drives the inner eccentric ring 70 in one of the angular directions 90, 92, respectively, at an angular speed $\omega_3$. In an exemplary embodiment, the inner driver (not shown) includes a brake, which is operable to decrease or halt the angular speed $\omega_3$ of the inner eccentric ring 70 in relation to the outer eccentric ring 68. In several exemplary embodiments, the outer and inner drivers (not shown) are adapted to control the angular speeds $\omega_2$, $\omega_3$, respectively, such that the angle and azimuth of the bit shaft 62 in relation to the formation 14 can be selectively changed or maintained. For example, when the angular speed $\omega_3$ of the inner eccentric ring 70 in relation to the outer eccentric ring 68 is zero, and the angular speed $\omega_2$ of the outer eccentric ring 68 in the angular direction 92 equal to the angular speed $\omega_1$ of the collar 60 in the angular direction 90, both the angle and azimuth of the bit shaft 62 in relation to the formation 14 remain constant. Any subsequent variation of the above described relationship between the angular speeds $\omega_1$, $\omega_2$, $\omega_3$ will result in a change in one or both of the angle and azimuth of the bit shaft 62 in relation to the formation 14, thus facilitating a change in the direction and/or path of the wellbore 38. Furthermore, once the above-described relationship between the angular speeds $\omega_1$, $\omega_2$, $\omega_3$ has been reestablished, the angle and azimuth of the bit shaft 62 in relation to the formation 14 will again remain constant.

Figure 6:
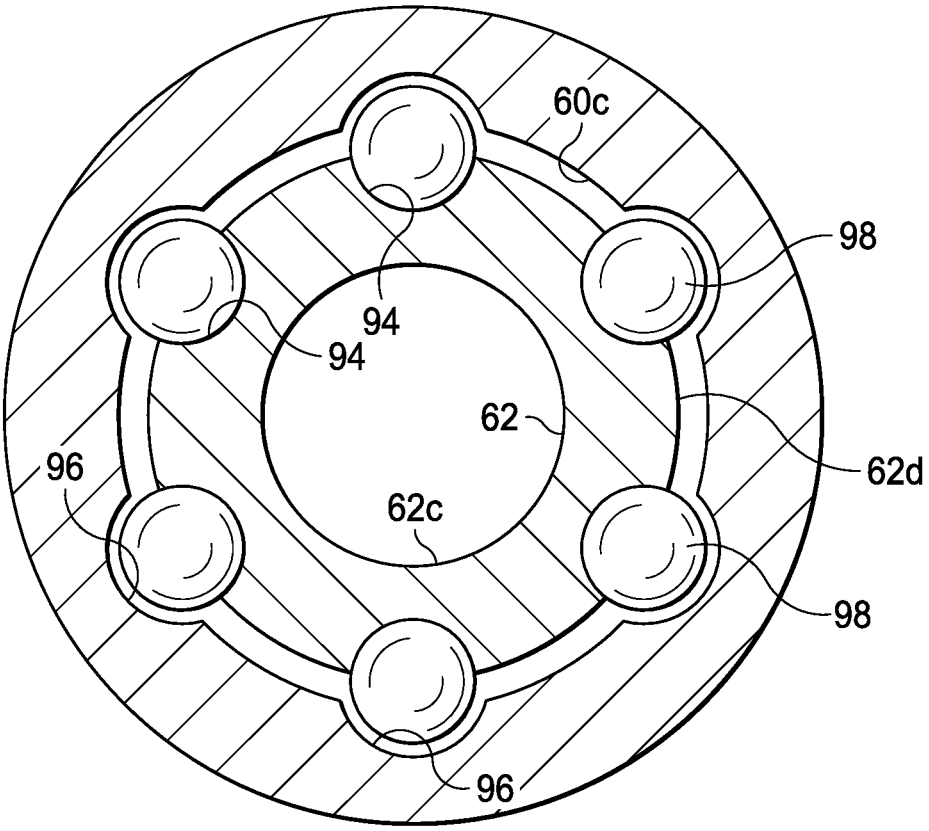
FIG. 6 is a cross-sectional diagrammatic view of the universal joint of FIGS. 2 and 3, taken along line 6-6 of FIG. 2, according to an exemplary embodiment.

In an exemplary embodiment, as illustrated in FIG. 6 with continuing reference to FIGS. 2 and 3, the universal joint 66 includes a plurality of concave cavities 94, a plurality of troughs 96, and a plurality of balls 98 accommodated within respective ones of the concave cavities 94 and the troughs 96. The plurality of concave cavities 94 are formed into the exterior surface 62*d* of the bit shaft 62 and are evenly spaced thereabout. The plurality of troughs 92 are formed into the interior surface 60*c* of the collar 60 at the end portion 60*a* thereof and are evenly spaced thereabout. Each of the troughs 96 extends axially along the interior surface 60*c* of the collar 60. In an exemplary embodiment, each of the troughs 96 extends helically along the interior surface 60*c* of the collar 60. Each of the plurality of balls 98 nests within a respective one of the concave cavities 94 formed into the bit shaft 62 and is accommodated within a respective one of the troughs 96 formed into the collar 60. During drilling operations, both the power section 58 (shown in FIG. 1) and the rotary table (not shown) impart torque and rotation to the collar 60, which torque and rotation are transferred to the bit shaft 62 through the universal joint 66. Specifically, torque is transferred from the collar 60 to the bit shaft 62 through the plurality of balls 98, which are nested within respective ones of the concave cavities 94 and are accommodated within respective ones of the troughs 96. As the angle and azimuth of the bit shaft 62 relative to the collar 60 are manipulated by the angulating mechanism 64 during drilling operations, each of the plurality of balls 98 is adapted to move longitudinally along the interior surface 60*c* of the collar 60 while remaining nested within respective ones of the concave cavities 94 and disposed within respective ones of the troughs 96. Thus, the universal joint 64 enables the transfer of torque from the collar 60 to the bit shaft 62 during drilling operations, even as the angle and azimuth of the bit shaft 62 relative to the collar 60 are changed by the angulating mechanism 64.

Figure 7:
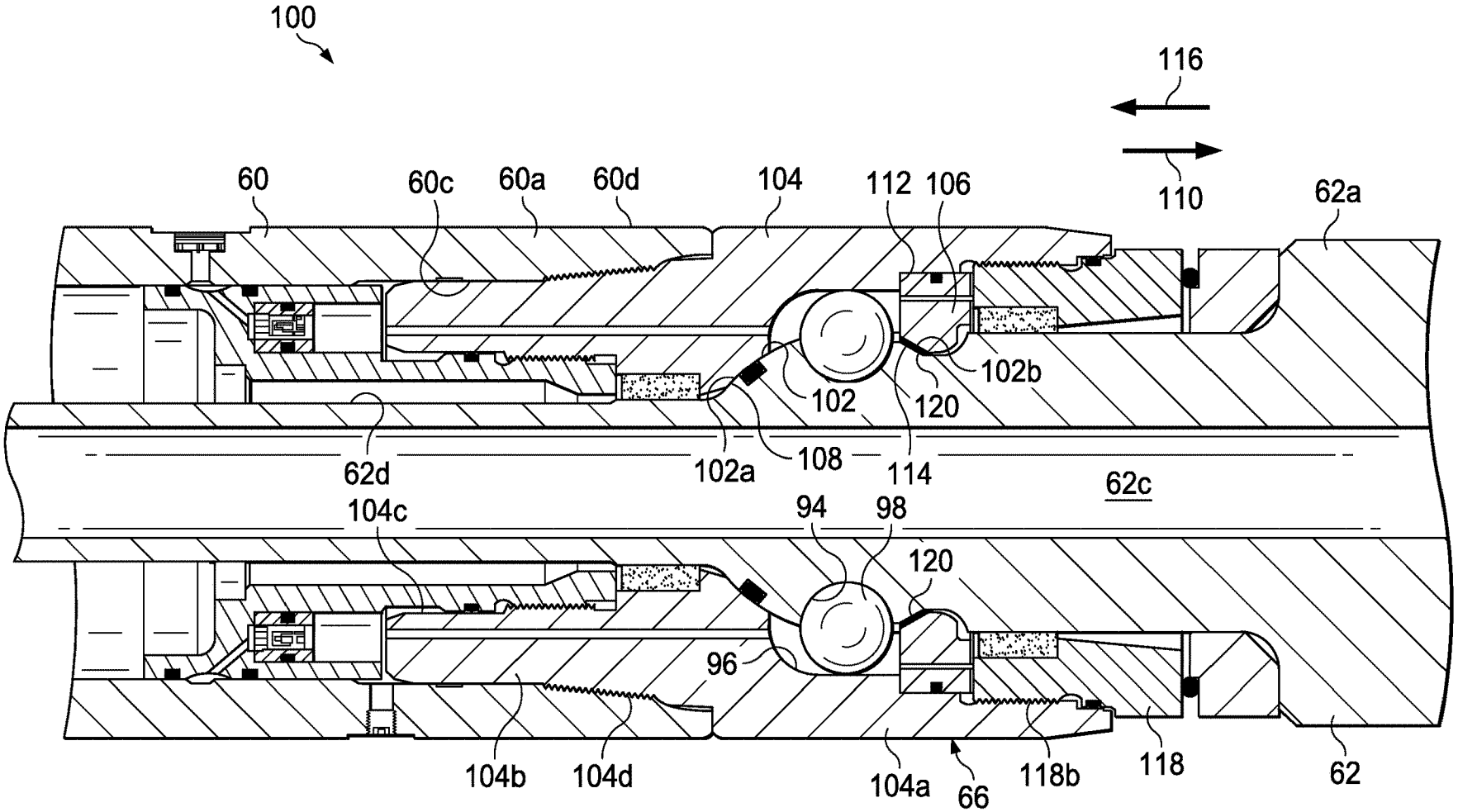
FIG. 7 is a detailed sectional view of the universal joint of FIGS. 2 and 3, including reference numerals delineating a load-bearing system, according to an exemplary embodiment.

In an exemplary embodiment, as illustrated in FIG. 7 with continuing reference to FIGS. 2, 3, and 6, the universal joint 66 further includes a load-bearing system 100, which is adapted to carry torsional loads, radial loads, and/or axial loads applied to the bit shaft 62. FIG. 7 is a more detailed view of the universal joint 66 than FIGS. 2, 3, and 6, which figures do not depict the load-bearing system 100. However, FIG. 7 includes several components of the embodiments shown in FIGS. 2, 3, and 6, which components are given the same reference numerals. In several exemplary embodiments, the load-bearing system 100 of FIG. 7 may be combined with one or more components of the embodiments shown in FIGS. 2, 3, and 6, in order to construct the rotary steerable drilling tool 50.

As shown in FIG. 7, the load-bearing system 100 includes a convex surface 102, a cup housing 104, and a spacer ring 106. The convex surface 102 forms a portion of the bit shaft 62 and extends circumferentially about the exterior surface 62*d* thereof. The plurality of concave cavities 94 are formed into the convex surface 102 of the bit shaft 62. The convex surface 102 defines contact surfaces 102*a*, 102*b*, respectively, which extend circumferentially about the bit shaft 62. The contact surfaces 102*a*, 102*b* are located adjacent the plurality of concave cavities 94 on opposite sides thereof.

The cup housing 104 forms a portion of the collar 60, and is considered part of the collar 60. The cup housing 104 defines opposing end portions 104*a*, 104*b*, an interior surface 104*c*, and an exterior surface 104*d*. The plurality of troughs 96 are formed into the interior surface 104*c* of the cup housing 104 at the end portion 104*a*. As discussed above, the plurality of balls 98 nest within respective ones of the concave cavities 94 and are accommodated within respective ones of the corresponding troughs 96, thereby carrying the torsional loads and a portion of the radial loads applied to the bit shaft 62. The end portion 104*b* of the cup housing 104 extends within the collar 60 and is threaded into the end portion 60*a* of the collar 60. In an exemplary embodiment, the end portion 104*a* of the cup housing 104 also extends within the collar 60 and is threaded into the end portion 60*a* of the collar 60. In several exemplary embodiments, the cup housing 104 is integrally formed with the collar 60. A concave surface 108 extends circumferentially about the interior surface 104*c* of the cup housing 104. The concave surface 108 is formed adjacent the plurality of troughs 96 and is adapted to mate with the contact surface 102*a* formed on the bit shaft 62, thereby carrying the axial loads applied to the bit shaft 62 in a direction 110. An internal shoulder 112 extends circumferentially about the end portion 104*a* of the cup housing 104, adjacent the plurality of troughs 96. The internal shoulder 112 and the concave surface 108 are formed into the cup housing 104 on opposite sides of the plurality of troughs 96.

The spacer ring 106 is disposed within the collar 60 and extends circumferentially about the bit shaft 62. A concave surface 114 is formed into the spacer ring 106 and extends circumferentially thereabout. The concave surface 114 is adapted to mate with the contact surface 102*b* formed on the bit shaft 62, thereby carrying the axial loads applied to the bit shaft 62 in a direction 116, which is opposite the direction 110. A lock-nut 118 extends circumferentially about the bit shaft 62 and defines an interior surface 118*a* and an exterior surface 118*b*. The exterior surface 118*b* of the lock-nut 118 is threadably engaged with the end portion 104*a* of the cup housing 104. In an exemplary embodiment, the spacer ring 106 is integrally formed with the lock-nut 118. As the lock-nut 118 is threaded into the cup housing 104, the spacer ring 106 is compressed between the lock-nut 118 and the internal shoulder 112. In this manner, the lock-nut 118 applies a pre-load to the spacer ring 106. Further, in this position, a portion of the spacer ring 106 bounds the plurality of troughs 96. Thus, respective portions of the spacer ring 106 at least partially define respective ones of the plurality of troughs 96.

A compliant member 120 is disposed between the bit shaft 62 and the spacer ring 106. The compliant member 120 is adapted to direct a portion of the pre-load, which is applied to the spacer ring 106 by the lock-nut 118, to the contact surface 102*b* formed on the bit shaft 62, thereby axially clamping the convex surface 102 of the bit shaft 62 between the concave surface 108 and the concave surface 114. The remainder of the pre-load is directed to the internal shoulder 112. As a result, the pre-load applied to the spacer ring 106 by the lock-nut 118 is split into two parts, with the first part directed to the contact surface 102*b* of the bit shaft 62 and the second part directed to the internal shoulder 112. In an exemplary embodiment, such axial clamping of the bit shaft 62 between the concave surface 108 and the concave surface 114 reduces the frictional torque and heat generated at the universal joint 66 during drilling operations.

In an exemplary embodiment, the load-bearing system 100 of the universal joint 66 eliminates the need for a conventional bearing stack to carry the axial and radial loads applied to the bit shaft 62 during drilling operations. In an exemplary embodiment, the load-bearing system 100 has a higher bearing surface contact area than that of a conventional bearing stack, thus resulting in less stress on the bearing surfaces and a longer useful life. In an exemplary embodiment, the load-bearing system 100 allows for a shorter distance between the rotary drill bit 48 and the universal joint 66, which, in turn, results in a higher possible angle and azimuth between the bit shaft 62 and the collar 60.

Figure 8:
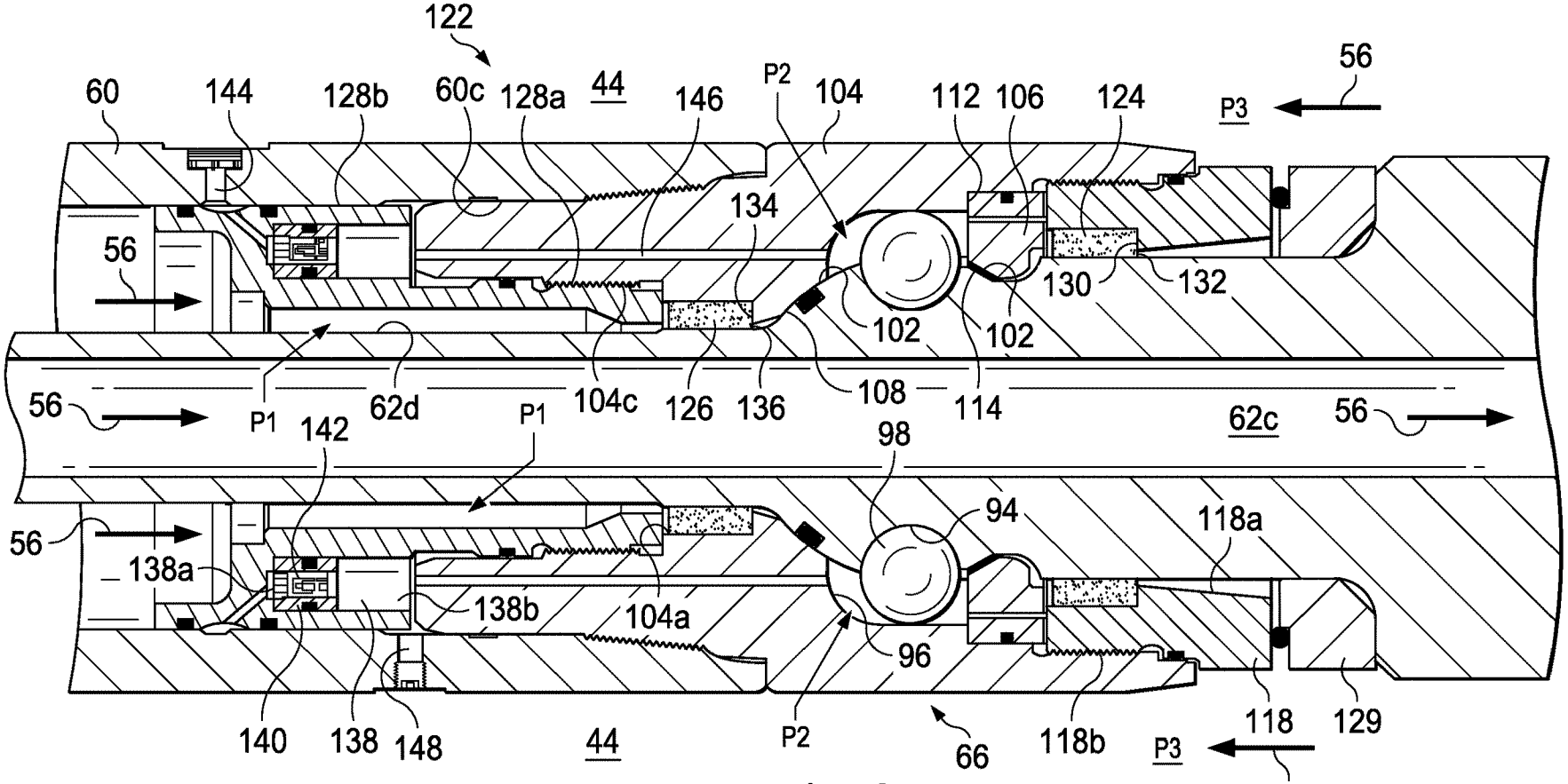
FIG. 8 is a detailed sectional view of the universal joint of FIGS. 2 and 3, which is identical to the view of FIG. 7 but omits the reference numerals delineating the load-bearing system in favor of reference numerals delineating a sealing system, according to an exemplary embodiment.

In an exemplary embodiment, as illustrated in FIG. 8 with continuing reference to FIGS. 2, 3, 6, and 7, the universal joint 66 further includes a sealing system 122, which is adapted to prevent debris from entering the load-bearing system 100. Specifically, the sealing system 122 is adapted to prevent the drilling fluid 56, the drill cuttings (not shown), and/or other debris from coming into contact with the plurality of concave cavities 94, the plurality of troughs 96, the plurality of balls 98, the convex surface 102, or the concave surfaces 108, 114. FIG. 8, which is identical to FIG. 7, is a more detailed view of the universal joint 66 than FIGS. 2, 3, and 6, which figures do not depict the load-bearing system 100 or the sealing system 122. However, FIG. 8 includes several components of the embodiments shown in FIGS. 2, 3, 6 and 7, which components are given the same reference numerals. In several exemplary embodiments, the sealing system 122 of FIG. 8 may be combined with one or more components of the embodiments shown in FIGS. 2, 3, 6 and 7, in order to construct the rotary steerable drilling tool 50.

As shown in FIG. 8, the sealing system 122 includes a seal 124, a seal 126, and a pressure compensator 128. In an exemplary embodiment the seals 124, 126 are self-energizing seals such as, for example, o-rings, lip seals, chevron seals, X-rings, square rings, U-seals, or an combination thereof. In an exemplary embodiment, the sealing system 122 also includes an excluder ring 129 extending circumferentially about the bit shaft 62 adjacent the lock-nut 118. The excluder ring 129 is adapted to prevent the drill cuttings (not shown) from entering the space between the lock-nut 118 and the bit shaft 62 adjacent the seal 124.

The seal 124 is seated against an internal shoulder 130, which is formed on the interior surface 118*a* of the lock-nut 118. The seal 124 is thus disposed between the interior surface 118*a* of the lock-nut 118 and the exterior surface 62*d* of the bit shaft 62. Further, an extrusion gap 132 is defined between the internal shoulder 130 and the bit shaft 62. In an exemplary embodiment, the extrusion gap 132 is adapted to accommodate the bit shaft 62 as the angle and azimuth of the bit shaft 62 relative to collar 60 are changed by the angulating mechanism 64 (not visible in FIG. 8). The internal shoulder 130 is formed as close as possible to the pivot point of the bit shaft 62, in order to reduce the size of the extrusion gap 132.

The seal 126 is seated against an internal shoulder 134, which is formed on the interior surface 104*a* of the cup housing 104, adjacent the concave surface 108. Hence, the internal shoulder 134 and the plurality of troughs 96 are formed into the cup housing 104 on opposite sides of the concave surface 108. The seal 126 is thus disposed between the interior surface 104*c* of the cup housing 104 and the exterior surface 62*d* of the bit shaft 62. Further, an extrusion gap 136 is defined between the internal shoulder 134 and the bit shaft 62. In an exemplary embodiment, the extrusion gap 136 is adapted to accommodate the bit shaft 62 as the angle and azimuth of the bit shaft 62 relative to collar 60 are changed by the angulating mechanism 64 (not visible in FIG. 8). The internal shoulder 134 is formed as close as possible to the pivot point of the bit shaft 62 in order to reduce the size of the extrusion gap 136.

The pressure compensator 128 is disposed within the collar 60 and extends circumferentially about the bit shaft 62. The pressure compensator 128 defines opposing end portions 128*a*, 128*b*. The end portion 128*a* of the pressure compensator 128 is sealingly engaged with the interior surface 104*c* of the cup housing 104 proximate the end portion 104*b* thereof. The end portion 128*b* of the pressure compensator 128 is sealingly engaged with the interior surface 60*c* of the collar 60. An annular chamber 138 defining opposing end portions 138*a*, 138*b*, is formed in the pressure compensator 128. A piston ring 140 is disposed within the annular chamber 138, forming a seal between the end portions 138*a*, 138*b*. In an exemplary embodiment, the piston ring 140 is adapted to move axially within the annular chamber 138 in response to the pressure differential between the end portions 138*a*, 138*b*, thereby balancing the pressure within the annular chamber 138. In an exemplary embodiment, a burst seal 142 is disposed within the piston ring 140. The burst seal 142 is operable to allow fluid communication between the end portion 138*a*, 138*b* of the annular chamber 138 once the pressure differential between the end portions 138*a*, 138*b* reaches a predetermined magnitude.

In operation, as illustrated in FIG. 8 with continuing reference to FIGS. 1-3, the drilling fluid 56 is circulated through the rotary steerable drilling tool 50 and into the annulus 44, thereby creating a pressure zone P1, a pressure zone P2, and a pressure zone P3. The pressure zone P1 is defined by an annular region formed between the pressure compensator 128 and the bit shaft 62. The pressure zone P2 is defined along the exterior surface 62*d* of the bit shaft 62 between the seals 124, 126. The pressure zone P3 is defined by the annulus 44 surrounding the collar 60. The end portion 138*a* of the annular chamber 138 is in fluid communication with the pressure zone P3 via a fluid port 144 formed in the collar 60. The end portion 138*b* of the annular chamber 138 is in fluid communication with the pressure zone P2 via a fluid duct 146 formed in the cup housing 104. The pressure zone P1 and the pressure zone P3 are filled with the drilling fluid 56 during drilling operations. The pressure zone P2 is filled with lubricating oil or grease, which is pumped into the pressure zone P2 through a port 148 formed in the collar 60. During drilling operations, the pressure in the pressure zone P1 is greater than the pressure in the pressure zone P2, thereby seating the seal 126 against the internal shoulder 134 and forming a fluid seal between the bit shaft 62 and the cup housing 104. Similarly, the pressure in the pressure zone P2 is greater than the pressure in the pressure zone P3, thereby seating the seal 124 against the internal shoulder 130 and forming a fluid seal between the bit shaft 62 and the lock-nut 118. However, the pressure within the annulus 44 is susceptible to pressure spikes during drilling operations. In an exemplary embodiment, when the pressure in the pressure zone P3 spikes above the pressure in the pressure zone P2, the piston ring 140 shifts within the annular chamber 138 to equalize the pressure between the end portions 138*a*, 138*b*, of the annular chamber 138. However, the displacement of the piston ring 140 within the annular chamber 138 may be insufficient to equalize the pressure at the end portions 138*a*, 138*b*. If this is the case, once the pressure differential reaches a predetermined magnitude, the burst seal 142 bursts to allow fluid communication between the end portions 138*a*, 138*b*. As a result, the piston ring 140 and the burst seal 142 are together operable to maintain the seal 124 seated against the internal shoulder 130.

In an exemplary embodiment, the sealing system 122 is operable to seal the load-bearing system 100 with increased reliability and improved seal performance. In an exemplary embodiment, the sealing system 122 allows for a shorter distance between the rotary drill bit 48 and the universal joint 66, which, in turn, results in a higher possible angle and azimuth between the bit shaft 62 and the collar 60. In an exemplary embodiment, the sealing system 122 is capable of handling higher differential pressures than a conventional universal joint sealing mechanism. In an exemplary embodiment, the differential pressure between the pressure zone P2 and the pressure zone P3 is relatively low, thereby increasing the useful life of the seal 124. In an exemplary embodiment, the sealing system 122 reduces the space needed for components, thus providing more space for other sensors closer to the rotary drill bit 48.

The present disclosure introduces a rotary steerable drilling tool adapted to be disposed within a wellbore, the rotary steerable drilling tool including a collar defining an interior surface and a first longitudinal axis; a shaft extending within the collar, the shaft defining an exterior surface and a second longitudinal axis; a universal joint adapted to transfer rotation from the collar to the shaft when the collar is rotated; a convex surface connected to the exterior surface of the shaft and extending circumferentially thereabout; a first concave surface extending circumferentially about the shaft, the first concave surface adapted to mate with the convex surface to carry a first axial load applied to the shaft in a first direction; wherein the first axial load is applied to the shaft when the first and second longitudinal axes are spaced in either an oblique relation or a parallel relation. In an exemplary embodiment, the rotary steerable drilling tool further includes a spacer ring disposed within the collar, the spacer ring including a second concave surface extending circumferentially about the shaft and adapted to mate with the convex surface to carry a second axial load applied to the shaft in a second direction, which is opposite the first direction; and wherein the second axial load is applied to the shaft when the first and second longitudinal axes are spaced in either an oblique relation or a parallel relation. In an exemplary embodiment, the rotary steerable drilling tool further includes an internal shoulder formed into the interior surface of the collar; and a lock-nut threadably engaged with the collar, the lock-nut extending circumferentially about the shaft; wherein the lock-nut compresses the spacer ring against the internal shoulder, thereby applying a pre-load to the spacer ring. In an exemplary embodiment, the rotary steerable drilling tool further includes a first seal disposed between the lock-nut and the exterior surface of the shaft, the first seal being adapted to seat against a first shoulder formed into the lock-nut; wherein the first seal is adapted to seal the universal joint, the convex surface, and the first and second concave surfaces, respectively, when the collar is rotated and the first and second longitudinal axes are spaced in either an oblique relation or a parallel relation. In an exemplary embodiment, the rotary steerable drilling tool further includes a second seal disposed between the collar and the exterior surface of the shaft, the second seal being adapted to seat against a second shoulder formed into the interior surface of the collar; wherein the second seal is adapted to seal the universal joint, the convex surface, and the first and second concave surfaces, respectively, when the collar is rotated and the first and second longitudinal axes are spaced in either an oblique relation or a parallel relation; and wherein the second shoulder is located adjacent the first concave surface such that the first concave surface is located between the plurality of troughs and the second shoulder. In an exemplary embodiment, the first and second seals each contact the shaft on opposite sides of the convex surface. In an exemplary embodiment, a compliant member is disposed between the spacer ring and the shaft, the compliant member being adapted to transfer a portion of the pre-load from the spacer ring to the convex surface of the shaft, thereby clamping the convex surface of the shaft between the first concave surface and the second concave surface.

The present disclosure also introduces a rotary steerable drilling tool adapted to be disposed within a wellbore, the rotary steerable drilling tool including a collar defining a first longitudinal axis; a shaft extending within the collar and defining a second longitudinal axis; a universal joint adapted to transfer rotation from the collar to the shaft and to carry axial loads applied to the shaft; and first and second seals adapted to seal the universal joint, the first and second seals being disposed within the collar and extending circumferentially about the shaft, the first and second seals being located on opposite sides of the universal joint; wherein the collar is rotated while the first and second longitudinal axes are spaced in either an oblique relation or a parallel relation. In an exemplary embodiment, the universal joint includes a convex surface connected to the shaft and extending circumferentially thereabout; a first concave surface extending circumferentially about the shaft, the first concave surface adapted to mate with the convex surface; a spacer ring disposed within the collar, the spacer ring defining a second concave surface extending circumferentially about the shaft, the second concave surface being adapted to mate with the convex surface. In an exemplary embodiment, the rotary steerable drilling tool further includes an internal shoulder formed into the collar; and a lock-nut extending circumferentially about the shaft and threadably engaged with the collar; wherein the spacer ring is compressed between the lock-nut and the internal shoulder; wherein the first concave surface is adapted to carry a first axial load applied to the shaft in a first direction; and wherein the second concave surface is adapted to carry a second axial load applied to the shaft in a second direction, which is opposite the first direction. In an exemplary embodiment, the first and second seals each contact the shaft on opposite sides of the convex surface; wherein the first seal is disposed between the lock-nut and the shaft, the first seal being adapted to seat against a first shoulder formed into the lock-nut; wherein the second seal is disposed between the collar and the shaft, the second seal being adapted to seat against a second shoulder formed into the collar. In an exemplary embodiment, the rotary steerable drilling tool further includes first and second extrusion gaps defined between the shaft and the first and second shoulders, respectively; and wherein the first and second extrusion gaps are capable of accommodating the shaft when the collar is rotated while the first and second longitudinal axes are spaced in either an oblique relation or a parallel relation. In an exemplary embodiment, the first and second seals are self-energizing seals; wherein the first seal is seated against the first shoulder by a pressure differential across the first extrusion gap; and wherein the second seal is seated against the second shoulder by a pressure differential across the second extrusion gap. In an exemplary embodiment, the sealing system further includes a pressure compensator extending circumferentially about the shaft adjacent the second seal and sealingly engaging the collar, the pressure compensator including an annular chamber defining first and second end portions; and at least one of: a piston ring disposed within the annular chamber and adapted to move axially, thereby balancing the respective pressures at the first and second end portions of the annular chamber; and a burst seal disposed within the annular chamber and operable to allow fluid communication between the first and second end portions of the annular chamber when the pressure differential therebetween reaches a predetermined magnitude, thereby balancing the respective pressures at the first and second end portions of the annular chamber. In an exemplary embodiment, the rotary steerable drilling tool further includes a first pressure zone defined by an annular region formed between the pressure compensator and the shaft; a second pressure zone defined along the shaft between the first and second seals; and a third pressure zone defined by an annulus formed between the collar and the wellbore when the rotary steerable drilling tool is disposed within the wellbore; wherein the first end portion of the annular chamber is in fluid communication with the second pressure zone; and wherein the second end portion of the annular chamber is adapted to be in fluid communication with the third pressure zone when the rotary steerable drilling tool is disposed within the wellbore. In an exemplary embodiment, the pressure compensator is operable to maintain the pressure in the second pressure zone at a level greater than or equal to the pressure in the third pressure zone; wherein the first seal is seated against the first shoulder in response to a pressure differential between the second and third pressure zones; and wherein the second seal is seated against the second shoulder in response to a pressure differential between the first and second pressure zones.

The present disclosure also introduces a method for sealing a universal joint adapted to transfer rotation from a collar to a shaft that extends within the collar, the method including providing the collar, the shaft, the universal joint, and first and second shoulders between which the universal joint is positioned, the collar and the shaft defining first and second longitudinal axes, respectively; providing first and second self-energizing seals between the collar and the shaft, the first and second self-energizing seals extending circumferentially about the shaft on opposite sides of the universal joint; rotating the collar while the first and second longitudinal axes are spaced in either an oblique relation or a parallel relation, thereby rotating the shaft; seating the first self-energizing seal against the first shoulder by applying a first pressure differential across a first extrusion gap, the first extrusion gap being defined between the first shoulder and the shaft; and seating a second self-energizing seal against the second shoulder by applying a second pressure differential across a second extrusion gap, the second extrusion gap being defined between the second shoulder and the shaft. In an exemplary embodiment, the universal joint includes a convex surface connected to the shaft and extending circumferentially thereabout; a first concave surface extending circumferentially about the shaft, the first concave surface adapted to mate with the convex surface; a spacer ring disposed within the collar, the spacer ring defining a second concave surface extending circumferentially about the shaft, the second concave surface being adapted to mate with the convex surface; wherein the first concave surface is adapted to carry a first axial load applied to the shaft in a first direction; and wherein the second concave surface is adapted to carry a second axial load applied to the shaft in a second direction, which is opposite the first direction. In an exemplary embodiment, the universal joint further includes a third shoulder formed into the collar; and a lock-nut extending circumferentially about the shaft and threadably engaged with the collar; wherein the spacer ring is compressed between the lock-nut and the internal shoulder. In an exemplary embodiment, the convex surface and the first and second concave surfaces are disposed axially between the first and second shoulders; wherein the first shoulder is formed into the lock-nut and the second shoulder is formed into the collar; and wherein the first and second seals each contact the shaft on opposite sides of the convex surface.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

Although several exemplary embodiments have been disclosed in detail above, the embodiments disclosed are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A rotary steerable drilling tool adapted to be disposed within a wellbore, the rotary steerable drilling tool comprising:

a collar defining an interior surface and a first longitudinal axis;

a shaft extending within the collar, the shaft defining an exterior surface and a second longitudinal axis;

a universal joint adapted to transfer rotation from the collar to the shaft when the collar is rotated;

one or more convex surfaces connected to the shaft and extending circumferentially thereabout;

first and second concave surfaces extending circumferentially about the shaft on opposite sides of the universal joint, the first concave surface being adapted to mate with at least one of the one or more convex surfaces to carry a first axial load applied to the shaft in a first direction, and the second concave surface being adapted to mate with at least one of the one or more convex surfaces to carry a second axial load applied to the shaft in a second direction, which is opposite the first direction;

wherein the first and second axial loads are applied to the shaft when the first and second longitudinal axes are spaced in either an oblique relation or a parallel relation.

2. The rotary steerable drilling tool of claim 1, wherein the rotary steerable drilling tool further comprises a spacer ring disposed within the collar, the spacer ring comprising the second concave surface.

3. The rotary steerable drilling tool of claim 2, wherein the rotary steerable drilling tool further comprises:

an internal shoulder formed into the interior surface of the collar; and a lock-nut threadably engaged with the collar, the lock-nut extending circumferentially about the shaft; and wherein the lock-nut compresses the spacer ring against the internal shoulder, thereby applying a pre-load to the spacer ring.

4. The rotary steerable drilling tool of claim 3, wherein the rotary steerable drilling tool further comprises:

a first seal disposed between the lock-nut and the exterior surface of the shaft, the first seal being adapted to seat against a first shoulder formed into the lock-nut;

wherein the first seal is adapted to seal the universal joint, the one or more convex surfaces, and the first and second concave surfaces, respectively, when the collar is rotated and the first and second longitudinal axes are spaced in either an oblique relation or a parallel relation.

5. The rotary steerable drilling tool of claim 4, wherein the rotary steerable drilling tool further comprises:

a second seal disposed between the collar and the exterior surface of the shaft, the second seal being adapted to seat against a second shoulder formed into the interior surface of the collar;

wherein the second seal is adapted to seal the universal joint, the one or more convex surfaces, and the first and second concave surfaces, respectively, when the collar is rotated and the first and second longitudinal axes are spaced in either an oblique relation or a parallel relation; and wherein the second shoulder is located adjacent the first concave surface such that the first concave surface is located between the universal joint and the second shoulder.

6. The rotary steerable drilling tool of claim 5, wherein the first and second seals each contact the shaft on opposite sides of the one or more convex surfaces.

7. The rotary steerable drilling tool of claim 3, wherein a compliant member is disposed between the spacer ring and the shaft, the compliant member being adapted to transfer a portion of the pre-load from the spacer ring to at least one of the one or more convex surfaces of the shaft, thereby clamping the one or more convex surfaces of the shaft between the first concave surface and the second concave surface.

8. A rotary steerable drilling tool adapted to be disposed within a wellbore, the rotary steerable drilling tool comprising:

a collar defining an interior surface and a first longitudinal axis;

a shaft extending within the collar, the shaft defining an exterior surface and a second longitudinal axis;

a universal joint adapted to transfer rotation from the collar to the shaft when the collar is rotated;

a convex surface connected to the shaft and extending circumferentially thereabout;

a first concave surface extending circumferentially about the shaft, the first concave surface adapted to mate with the convex surface to carry a first axial load applied to the shaft in a first direction;

wherein the first axial load is applied to the shaft when the first and second longitudinal axes are spaced in either an oblique relation or a parallel relation;

wherein the rotary steerable drilling tool further comprises a spacer ring disposed within the collar, the spacer ring comprising:

a second concave surface extending circumferentially about the shaft and adapted to mate with the convex surface to carry a second axial load applied to the shaft in a second direction, which is opposite the first direction;

wherein the second axial load is applied to the shaft when the first and second longitudinal axes are spaced in either an oblique relation or a parallel relation;

wherein the rotary steerable drilling tool further comprises:

an internal shoulder formed into the interior surface of the collar; and a lock-nut threadably engaged with the collar, the lock-nut extending circumferentially about the shaft; and wherein the lock-nut compresses the spacer ring against the internal shoulder, thereby applying a pre-load to the spacer ring.

9. The rotary steerable drilling tool of claim 8, wherein the rotary steerable drilling tool further comprises:

a first seal disposed between the lock-nut and the exterior surface of the shaft, the first seal being adapted to seat against a first shoulder formed into the lock-nut;

wherein the first seal is adapted to seal the universal joint, the convex surface, and the first and second concave surfaces, respectively, when the collar is rotated and the first and second longitudinal axes are spaced in either an oblique relation or a parallel relation.

10. The rotary steerable drilling tool of claim 9, wherein the rotary steerable drilling tool further comprises:

a second seal disposed between the collar and the exterior surface of the shaft, the second seal being adapted to seat against a second shoulder formed into the interior surface of the collar;

wherein the second seal is adapted to seal the universal joint, the convex surface, and the first and second concave surfaces, respectively, when the collar is rotated and the first and second longitudinal axes are spaced in either an oblique relation or a parallel relation; and wherein the second shoulder is located adjacent the first concave surface such that the first concave surface is located between the universal joint and the second shoulder.

11. The rotary steerable drilling tool of claim 10, wherein the first and second seals each contact the shaft on opposite sides of the convex surface.

12. The rotary steerable drilling tool of claim 8, wherein a compliant member is disposed between the spacer ring and the shaft, the compliant member being adapted to transfer a portion of the pre-load from the spacer ring to the convex surface of the shaft, thereby clamping the convex surface of the shaft between the first concave surface and the second concave surface.

13. A rotary steerable drilling tool adapted to be disposed within a wellbore, the rotary steerable drilling tool comprising:

a collar defining a first longitudinal axis;

a shaft extending within the collar and defining a second longitudinal axis;

a universal joint adapted to transfer rotation from the collar to the shaft and to carry axial loads applied to the shaft;

first and second shoulders between which the universal joint is positioned; and first and second self-energizing seals adapted to seal the universal joint, the first and second self-energizing seals being disposed within the collar and extending circumferentially about the shaft, and the first and second self-energizing seals being located on opposite sides of the universal joint;

wherein the first self-energizing seal is adapted to be seated against the first shoulder by applying a first pressure differential across a first extrusion gap, the first extrusion gap being defined between the first shoulder and the shaft;

wherein the second self-energizing seal is adapted to be seated against the second shoulder by applying a second pressure differential across a second extrusion gap, the second extrusion gap being defined between the second shoulder and the shaft; and wherein the first and second self-energizing seals are adapted to seal the universal joint while the collar is rotated and the first and second longitudinal axes are spaced in either an oblique relation or a parallel relation.

14. The rotary steerable drilling tool of claim 13, wherein the universal joint comprises:

one or more convex surfaces connected to the shaft and extending circumferentially thereabout;

a first concave surface extending circumferentially about the shaft, the first concave surface adapted to mate with at least one of the one or more convex surfaces;

a spacer ring disposed within the collar, the spacer ring defining a second concave surface extending circumferentially about the shaft, the second concave surface being adapted to mate with at least one of the one or more convex surfaces.

15. The rotary steerable drilling tool of claim 14, wherein the rotary steerable drilling tool further comprises:

an internal shoulder formed into the collar; and a lock-nut extending circumferentially about the shaft and threadably engaged with the collar;

wherein the spacer ring is compressed between the lock-nut and the internal shoulder;

wherein the first concave surface is adapted to carry a first axial load applied to the shaft in a first direction; and wherein the second concave surface is adapted to carry a second axial load applied to the shaft in a second direction, which is opposite the first direction.

16. The rotary steerable drilling tool of claim 15, wherein the first and second self-energizing seals each contact the shaft on opposite sides of the one or more convex surfaces;

wherein the first self-energizing seal is disposed between the lock-nut and the shaft, the first self-energizing seal being adapted to seat against the first shoulder, which first shoulder is formed into the lock-nut;

wherein the second self-energizing seal is disposed between the collar and the shaft, the second self-energizing seal being adapted to seat against the second shoulder, which second shoulder is formed into the collar.

17. The rotary steerable drilling tool of claim 16, wherein the first and second extrusion gaps are capable of accommodating the shaft when the collar is rotated while the first and second longitudinal axes are spaced in either an oblique relation or a parallel relation.

18. The rotary steerable drilling tool of claim 16, further comprising a pressure compensator extending circumferentially about the shaft adjacent the second self-energizing seal and sealingly engaging the collar, the pressure compensator comprising:

an annular chamber defining first and second end portions; and at least one of:

a piston ring disposed within the annular chamber and adapted to move axially, thereby balancing the respective pressures at the first and second end portions of the annular chamber;

and a burst seal disposed within the annular chamber and operable to allow fluid communication between the first and second end portions of the annular chamber when the pressure differential therebetween reaches a predetermined magnitude, thereby balancing the respective pressures at the first and second end portions of the annular chamber.

19. The rotary steerable drilling tool of claim 18, wherein the rotary steerable drilling tool further comprises:

a first pressure zone defined by an annular region formed between the pressure compensator and the shaft;

a second pressure zone defined along the shaft between the first and second self-energizing seals; and a third pressure zone defined by an annulus formed between the collar and the wellbore when the rotary steerable drilling tool is disposed within the wellbore;

wherein the first end portion of the annular chamber is in fluid communication with the second pressure zone; and wherein the second end portion of the annular chamber is adapted to be in fluid communication with the third pressure zone when the rotary steerable drilling tool is disposed within the wellbore.

20. The rotary steerable drilling tool of claim 19, wherein the pressure compensator is operable to maintain the pressure in the second pressure zone at a level greater than or equal to the pressure in the third pressure zone;

wherein the first self-energizing seal is seated against the first shoulder in response to a pressure differential between the second and third pressure zones; and wherein the second self-energizing seal is seated against the second shoulder in response to a pressure differential between the first and second pressure zones.

21. A rotary steerable drilling tool adapted to be disposed within a wellbore, the rotary steerable drilling tool comprising:

a collar defining a first longitudinal axis;

a shaft extending within the collar and defining a second longitudinal axis;

a universal joint adapted to transfer rotation from the collar to the shaft and to carry axial loads applied to the shaft; and first and second seals adapted to seal the universal joint, the first and second seals being disposed within the collar and extending circumferentially about the shaft, and the first and second seals being located on opposite sides of the universal joint;

wherein the collar is rotated while the first and second longitudinal axes are spaced in either an oblique relation or a parallel relation;

wherein the universal joint comprises:

a convex surface connected to the shaft and extending circumferentially thereabout;

a first concave surface extending circumferentially about the shaft, the first concave surface adapted to mate with the convex surface; and a spacer ring disposed within the collar, the spacer ring defining a second concave surface extending circumferentially about the shaft, the second concave surface being adapted to mate with the convex surface;

wherein the rotary steerable drilling tool further comprises:

an internal shoulder formed into the collar; and a lock-nut extending circumferentially about the shaft and threadably engaged with the collar;

wherein the spacer ring is compressed between the lock-nut and the internal shoulder;

wherein the first concave surface is adapted to carry a first axial load applied to the shaft in a first direction; and wherein the second concave surface is adapted to carry a second axial load applied to the shaft in a second direction, which is opposite the first direction.

22. The rotary steerable drilling tool of claim 21, wherein the first and second seals each contact the shaft on opposite sides of the convex surface;

wherein the first seal is disposed between the lock-nut and the shaft, the first seal being adapted to seat against a first shoulder formed into the lock-nut; and wherein the second seal is disposed between the collar and the shaft, the second seal being adapted to seat against a second shoulder formed into the collar.

23. The rotary steerable drilling tool of claim 22, wherein the rotary steerable drilling tool further comprises first and second extrusion gaps defined between the shaft and the first and second shoulders, respectively; and wherein the first and second extrusion gaps are capable of accommodating the shaft when the collar is rotated while the first and second longitudinal axes are spaced in either an oblique relation or a parallel relation.

24. The rotary steerable drilling tool of claim 23, wherein the first and second seals are self-energizing seals;

wherein the first seal is seated against the first shoulder by a pressure differential across the first extrusion gap; and wherein the second seal is seated against the second shoulder by a pressure differential across the second extrusion gap.

25. The rotary steerable drilling tool of claim 22, further comprising a pressure compensator extending circumferentially about the shaft adjacent the second seal and sealingly engaging the collar, the pressure compensator comprising:

an annular chamber defining first and second end portions; and at least one of:

a piston ring disposed within the annular chamber and adapted to move axially, thereby balancing the respective pressures at the first and second end portions of the annular chamber;

and a burst seal disposed within the annular chamber and operable to allow fluid communication between the first and second end portions of the annular chamber when the pressure differential therebetween reaches a predetermined magnitude, thereby balancing the respective pressures at the first and second end portions of the annular chamber.

26. The rotary steerable drilling tool of claim 25, wherein the rotary steerable drilling tool further comprises:

a first pressure zone defined by an annular region formed between the pressure compensator and the shaft;

a second pressure zone defined along the shaft between the first and second seals; and a third pressure zone defined by an annulus formed between the collar and the wellbore when the rotary steerable drilling tool is disposed within the wellbore;

wherein the first end portion of the annular chamber is in fluid communication with the second pressure zone; and wherein the second end portion of the annular chamber is adapted to be in fluid communication with the third pressure zone when the rotary steerable drilling tool is disposed within the wellbore.

27. The rotary steerable drilling tool of claim 26, wherein the pressure compensator is operable to maintain the pressure in the second pressure zone at a level greater than or equal to the pressure in the third pressure zone;

wherein the first seal is seated against the first shoulder in response to a pressure differential between the second and third pressure zones; and wherein the second seal is seated against the second shoulder in response to a pressure differential between the first and second pressure zones.

28. A method for sealing a universal joint adapted to transfer rotation from a collar to a shaft that extends within the collar, the method comprising:

providing the collar, the shaft, the universal joint, and first and second shoulders between which the universal joint is positioned, the collar and the shaft defining first and second longitudinal axes, respectively;

providing first and second self-energizing seals between the collar and the shaft, the first and second self-energizing seals extending circumferentially about the shaft on opposite sides of the universal joint;

rotating the collar while the first and second longitudinal axes are spaced in either an oblique relation or a parallel relation, thereby rotating the shaft;

seating the first self-energizing seal against the first shoulder by applying a first pressure differential across a first extrusion gap, the first extrusion gap being defined between the first shoulder and the shaft; and seating a second self-energizing seal against the second shoulder by applying a second pressure differential across a second extrusion gap, the second extrusion gap being defined between the second shoulder and the shaft.

29. The method of claim 28, wherein the universal joint comprises:

a convex surface connected to the shaft and extending circumferentially thereabout;

a first concave surface extending circumferentially about the shaft, the first concave surface adapted to mate with the convex surface;

a spacer ring disposed within the collar, the spacer ring defining a second concave surface extending circumferentially about the shaft, the second concave surface being adapted to mate with the convex surface;

wherein the first concave surface is adapted to carry a first axial load applied to the shaft in a first direction; and wherein the second concave surface is adapted to carry a second axial load applied to the shaft in a second direction, which is opposite the first direction.

30. The method of claim 29, wherein the universal joint further comprises:

a third shoulder formed into the collar; and a lock-nut extending circumferentially about the shaft and threadably engaged with the collar;

wherein the spacer ring is compressed between the lock-nut and the internal shoulder.

31. The method of claim 30, wherein the convex surface and the first and second concave surfaces are disposed axially between the first and second shoulders;

wherein the first shoulder is formed into the lock-nut and the second shoulder is formed into the collar; and wherein the first and second seals each contact the shaft on opposite sides of the convex surface.

* * * * *